US012806468B2

(12) United States Patent
Lin

(10) Patent No.: US 12,806,468 B2
(45) Date of Patent: Nov. 24, 2026

(54) ELECTRIC TELESCOPIC HORIZONTAL BIKE

(71) Applicant: Cool Snail (Xiamen) Technology Co., Ltd., Xiamen (CN)

(72) Inventor: Xiqun Lin, Xiamen (CN)

(73) Assignee: Cool Snail (Xiamen) Technology Co., Ltd., Xiamen (CN)

( * ) Notice: Subject to any disclaimer, the term of this patent is extended or adjusted under 35 U.S.C. 154(b) by 70 days.

(21) Appl. No.: 18/919,920

(22) Filed: Oct. 18, 2024

(65) Prior Publication Data

US 2026/0108776 A1 Apr. 23, 2026

(30) Foreign Application Priority Data

Sep. 19, 2023 (CN) ..... 202322548475.1

(51) Int. Cl.
*A63B 22/06* (2006.01)

(52) U.S. Cl.
CPC ..... *A63B 22/0605* (2013.01); *A63B 2225/09* (2013.01)

(58) Field of Classification Search
CPC . A63B 22/0605; A63B 2225/09; A63B 23/04; A63B 69/0057; A63B 24/0062; A63B 22/02; A63B 22/0664; A63B 22/0056; A63B 2022/0652; A63B 2071/025; A47B 83/04; A47B 2220/06
See application file for complete search history.

(56) References Cited

U.S. PATENT DOCUMENTS

2009/0105046 A1* 4/2009 Rudich ..... A63B 22/0605 482/148
2009/0233767 A1* 9/2009 Huang ..... A63B 22/0605 482/57
2014/0187383 A1* 7/2014 Martin ..... A63B 23/04 482/142
2023/0134879 A1* 5/2023 Brown ..... A63B 21/00072 482/62

FOREIGN PATENT DOCUMENTS

CN 217908781 U * 11/2022

* cited by examiner

*Primary Examiner* — Andrew M Kobylarz
(74) *Attorney, Agent, or Firm* — Cooper Legal Group, LLC

(57) ABSTRACT

Disclosed is an electric telescopic horizontal bike, wherein a damping pedal assembly is disposed on a main frame; a sliding rod is disposed at a rear part of the main frame in a back-and-forth sliding manner, a seat fixing part is provided at a rear part of the sliding rod, first rollers are disposed at a bottom side of the seat fixing part, and the first rollers stand on the ground and are capable of rolling back and forth; the seat is mounted above the seat fixing part; and the electric driving mechanism is used for driving the sliding rod to slide back and forth, so as to drive the seat to move back and forth. According to the electric telescopic horizontal fitness bike, it is more convenient for users to get on and off the seat, and more space is saved during storage and transportation.

15 Claims, 7 Drawing Sheets

ELECTRIC TELESCOPIC HORIZONTAL BIKE

CROSS-REFERENCE TO RELATED APPLICATIONS

This application claims priority to Chinese Patent Application 202322548475.1, filed on Sep. 19, 2024, which is incorporated herein by reference.

TECHNICAL FIELD

The present invention relates to the technical field of fitness equipment, and in particular to an electric telescopic horizontal bike.

BACKGROUND

Fitness bikes are fitness equipment designed to imitate pedaling in cycling. At present, the fitness bikes are mainly divided into a vertical fitness bike and a horizontal fitness bike (also called a lazy bike in the art). A seat of the vertical fitness bike has a similar shape as that of a seat of a bicycle, which has a limited support for a human hip, and the seat is located at a higher position above a damping pedal assembly, so that a sitting posture of a user is similar to that of real riding, but it is not comfortable enough and the user tends to feel tired. A seat of the horizontal fitness bike is usually wide, which can support the whole hip and is equipped with a backrest, so it is very comfortable to ride. However, the seat of the horizontal fitness bike is in a low position and is usually located at a rear part of the damping pedal assembly, so it is inconvenient for the user to get on and off the seat of the horizontal fitness bike as a result of being hindered by the damping pedal assembly in front of the seat of the horizontal fitness bike.

SUMMARY

A purpose of the present invention is to provide an electric telescopic horizontal bike, which overcomes the above defects and makes it more convenient for users to get on and off a seat of the horizontal fitness bike.

In order to achieve the above purpose, a solution of the present invention is as follows: an electric telescopic horizontal bike includes a main frame, a damping pedal assembly, a sliding rod, a seat and an electric driving mechanism, wherein

- the main frame stands on the ground;
- the damping pedal assembly is disposed on the main frame;
- the sliding rod is disposed at a rear part of the main frame in a back-and-forth sliding manner, a seat fixing part is provided at a rear part of the sliding rod, first rollers are disposed at a bottom side of the seat fixing part, and the first rollers stand on the ground and are capable of rolling back and forth;
- the seat is mounted above the seat fixing part; and
- the electric driving mechanism is disposed between the main frame and the sliding rod, and is connected with the sliding rod and used for driving the sliding rod to slide back and forth, so as to drive the seat to move back and forth.

Further, a number of the first rollers is three, and connecting lines of positions of the three first rollers are distributed in a triangular mode.

Further, the seat fixing part is provided with one supporting rod extending upward within a range of the connecting lines of the positions of the three first rollers, and the seat is mounted at a top end of the supporting rod.

Further, the seat includes a seat surface, a backrest and armrests, the seat surface is used for a human body to sit on, the backrest is disposed at a rear side of the seat surface for the human body to lean on, and the armrests extend on sides of the seat surface.

Further, the electric telescopic horizontal bike further includes a manipulator, the manipulator controls and is connected with the electric driving mechanism and is disposed on the armrests, so as to control the electric driving mechanism to drive the sliding rod to slide back and forth or stop.

Further, the electric driving mechanism includes a lead screw, a motor and a lead screw nut, the lead screw extends back and forth and is rotatably mounted on the main frame around an axis, the motor is mounted on the main frame and connected to drive the lead screw to rotate forward or reversely, the lead screw nut is in screw-thread fit with the lead screw, and the sliding rod is fixed with the lead screw nut to slide forward or backward respectively under the driving of forward or reverse rotation of the lead screw.

Further, the damping pedal assembly includes a rotating shaft, a damping mechanism, a left crank, a right crank, a left pedal and a right pedal, wherein the rotating shaft extends laterally from left to right and can rotate around an axis; the damping mechanism is in transmission connection with the rotating shaft to provide damping for rotation of the rotating shaft around the axis; one end of the left crank is connected to a left end of the rotating shaft, and the other end of the right crank is connected to a right end of the rotating shaft, so that the left crank, the right crank and the rotating shaft are connected to form a Z-shape; and the left pedal is transversely pivoted to the other end of the left crank, and the right pedal is transversely pivoted to the other end of the right crank.

Further, supporting feet are disposed at a bottom side of the main frame, the main frame stands on the ground through the supporting feet, the main frame is provided with second rollers at front sides of the supporting feet, and the second rollers are capable of rolling back and forth.

Further, one outer pipe is disposed at the rear part of the main frame in a back-and-forth extension manner, and the sliding rod is movably inserted into a rear end of the outer pipe so as to be disposed at the rear part of the main frame in a back-and-forth sliding manner.

With the adoption of the solution, the present invention has the beneficial effects that:

(1) the main frame stands on the ground, the damping pedal assembly is disposed on the main frame, the sliding rod is disposed at the rear part of the main frame in a back-and-forth sliding manner, the seat fixing part is provided at a rear part of the sliding rod, the seat is mounted above the seat fixing part, the first rollers are disposed at the bottom side of the seat fixing part, the first rollers stand on the ground and are capable of rolling back and forth to support the sliding rod and the seat, the electric driving mechanism drives the sliding rod to slide back and forth, and the sliding rod, in turn, can be driven by the electric driving mechanism to slide backward to drive the seat to move backward, so that the seat gets far away from the damping pedal assembly, to form enough space between the damping pedal assembly and the seat, which is more convenient for the user to get on and off the seat; when the user sits in the seat, the sliding rod can be driven by the electric driving mechanism to slide forward to drive the seat to move forward, so that the distance between the seat and the damping pedal assembly can be reduced to an extent which is convenient for the user to exercise;

(2) after the sliding rod drives the seat to slide forward, a front-rear length of the whole horizontal bike will be reduced, which is more convenient for transportation and storage.

NUMERAL SIGNS

1—main frame, 2—damping pedal assembly, 3—sliding rod, 4—seat, 5—electric driving mechanism, 6—seat fixing part, 7—first roller, 8—supporting rod, 9—seat surface, 10—backrest, 11—armrest, 12—manipulator, 13—lead screw, 14—motor, 15—lead screw nut, 18—left crank, 19—right crank, 20—left pedal, 21—right pedal, 22—supporting foot, 23—second roller, 24—outer pipe, 25—transverse pipe, 26—forward button, 27—backward button, 28—controller, 29—power supply.

DESCRIPTION OF EMBODIMENTS

The present invention will be described in detail with the attached drawings and specific embodiments.

In the claims, the specification and the drawings of the present invention, unless otherwise specified, the terms "central," "lateral," "longitudinal," "horizontal," "vertical," "top," "bottom," "inner," "outer," "upper," "lower," "front," "rear," "left," "right," "clockwise," "counterclockwise," and the like in terms of orientation or positional relationship are used for ease of description and simplicity of description, and do not indicate or imply that the referenced device or element must be constructed and operated in a particular orientation or orientation, and thus are not to be construed as limiting the scope of the present invention.

Figure 1:
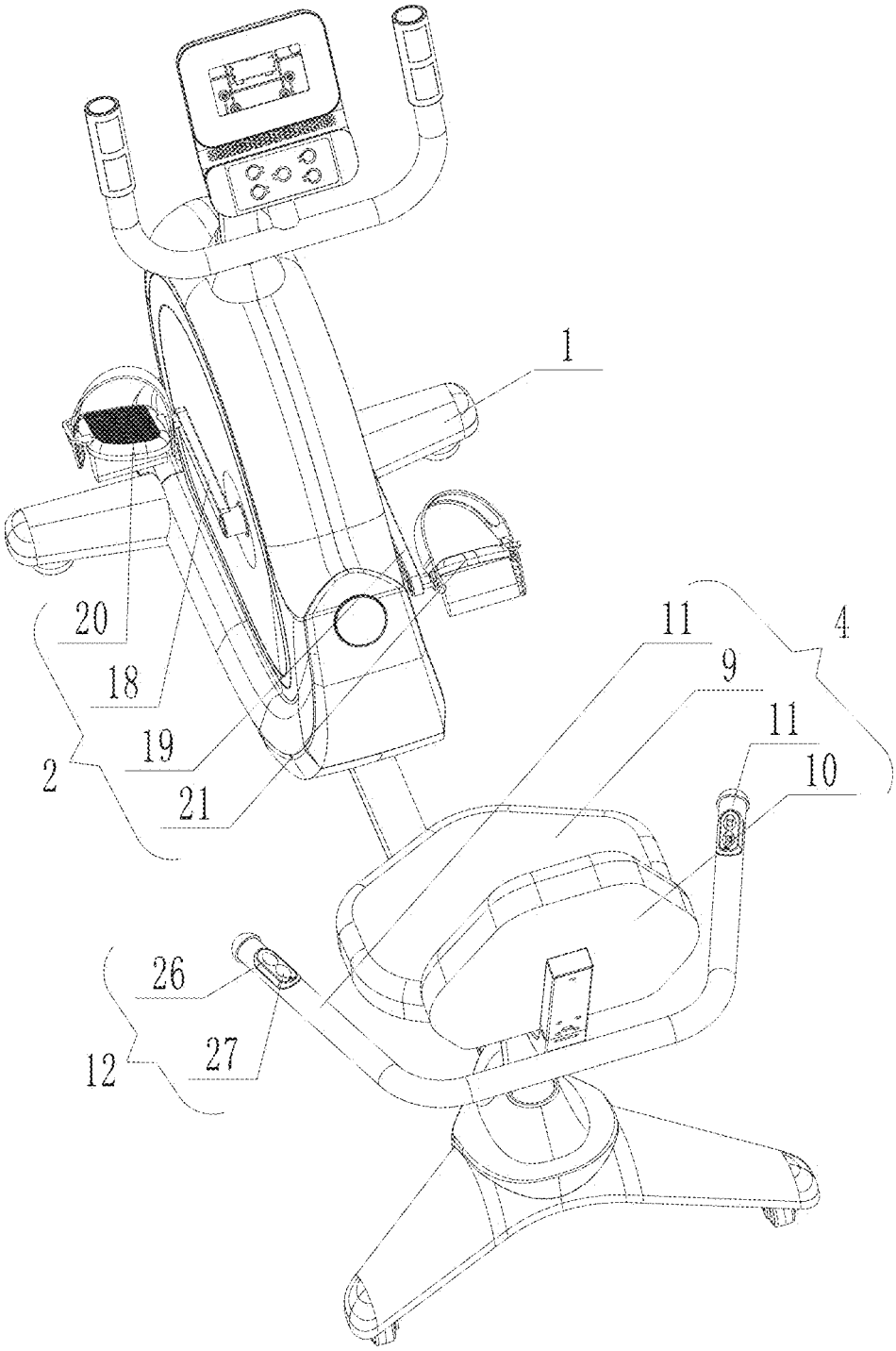
FIG. 1 is a perspective structural diagram from a top axial view of the present invention.
Figure 2:
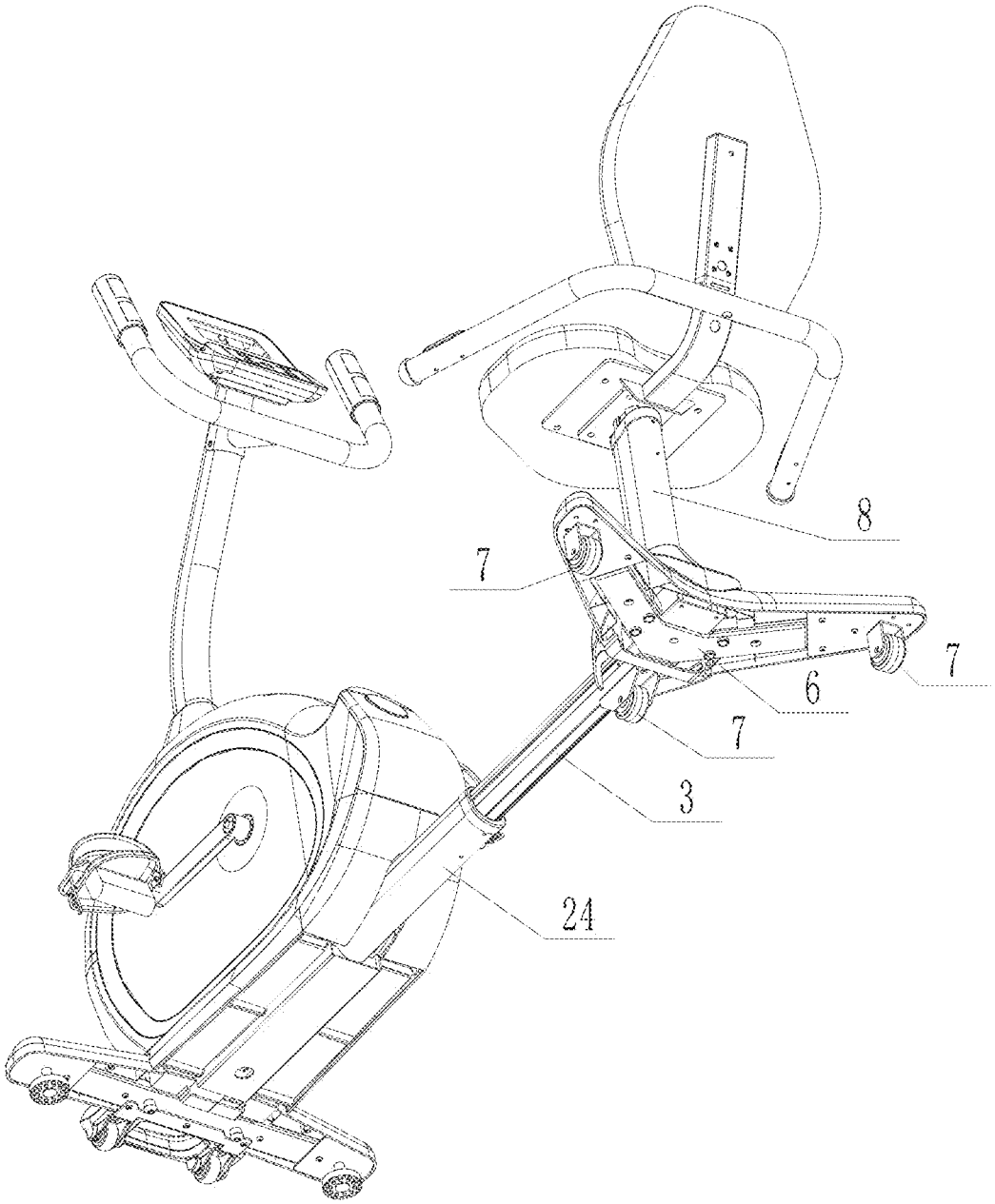
FIG. 2 is a perspective structural diagram from a bottom axial view when a seat moves backward, according to the present invention.
Figure 3:
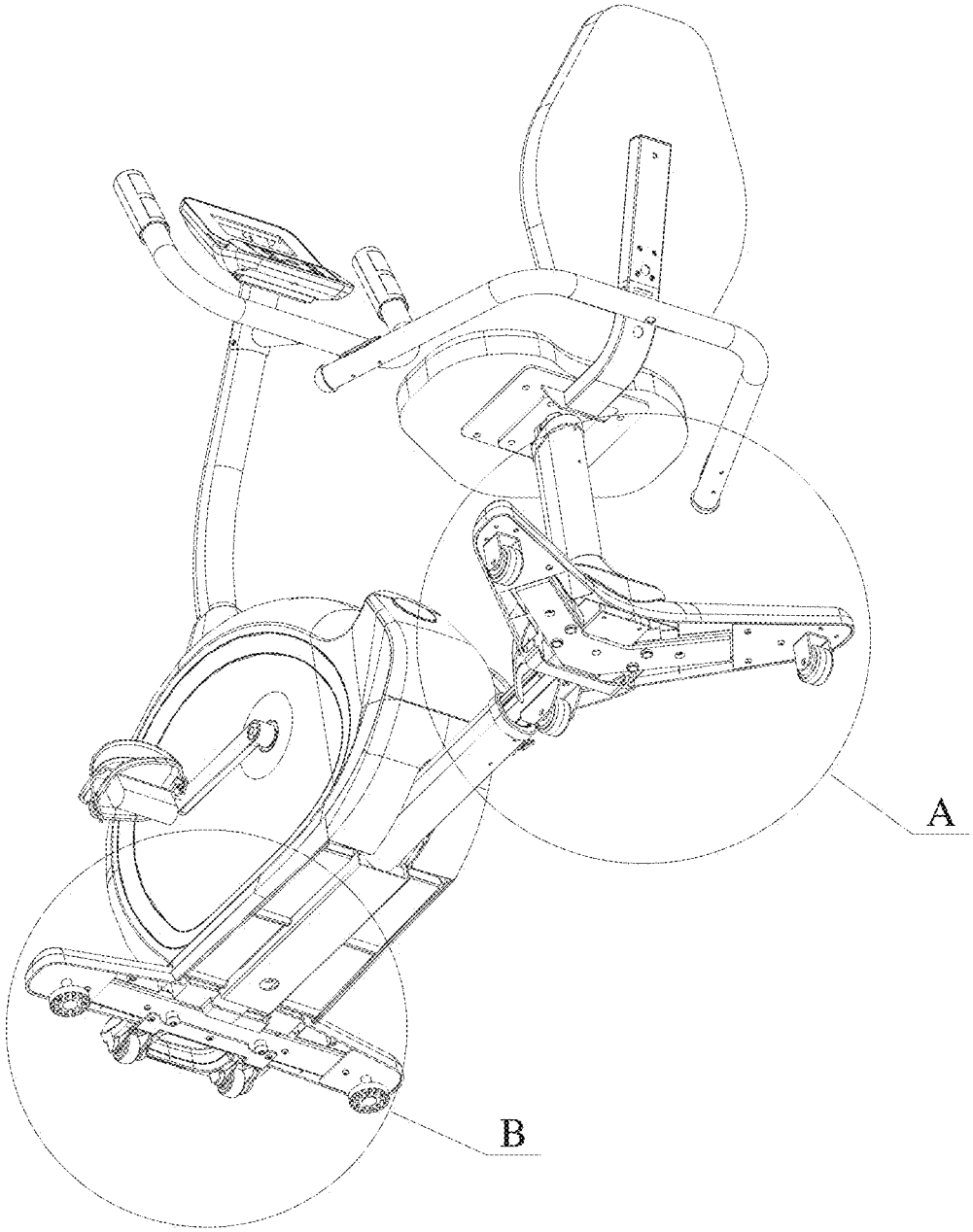
FIG. 3 is a perspective structural diagram from a bottom axial view when a seat moves forward, according to the present invention.
Figure 4:
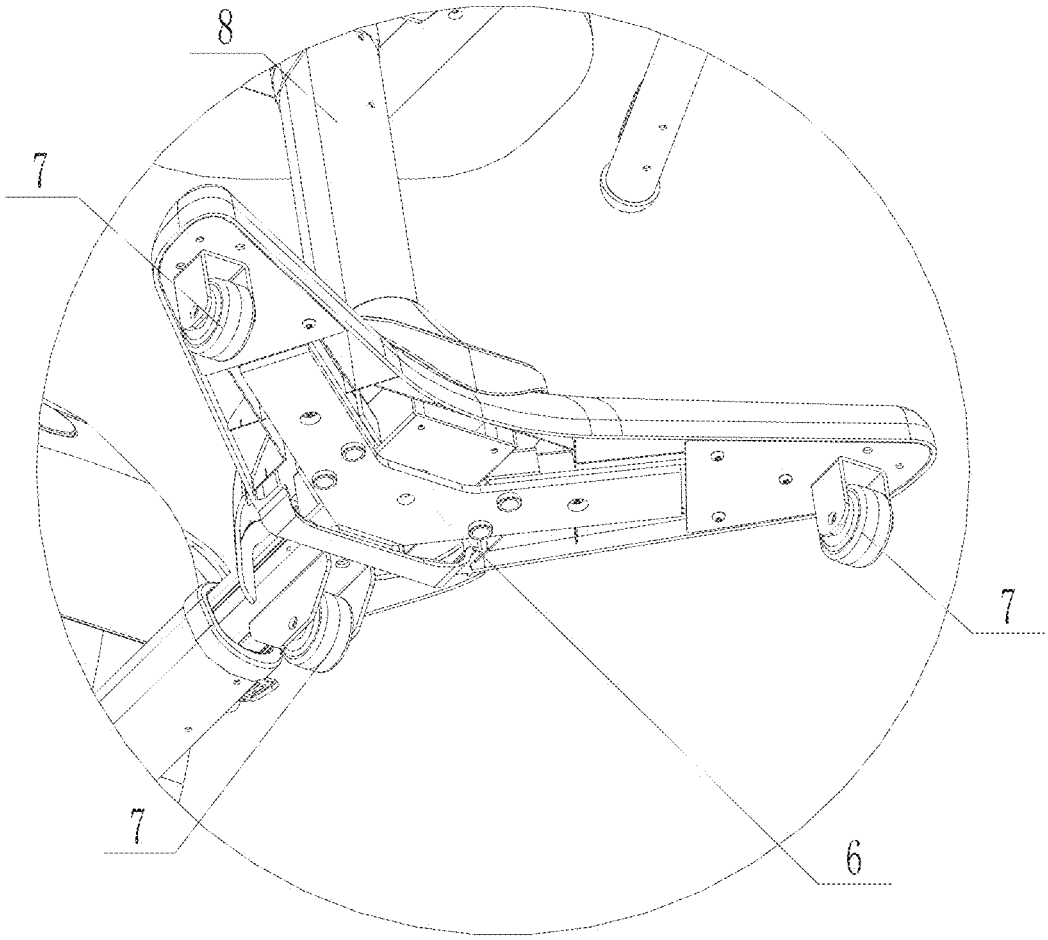
FIG. 4 is a partial enlarged view at A in FIG. 3.
Figure 5:
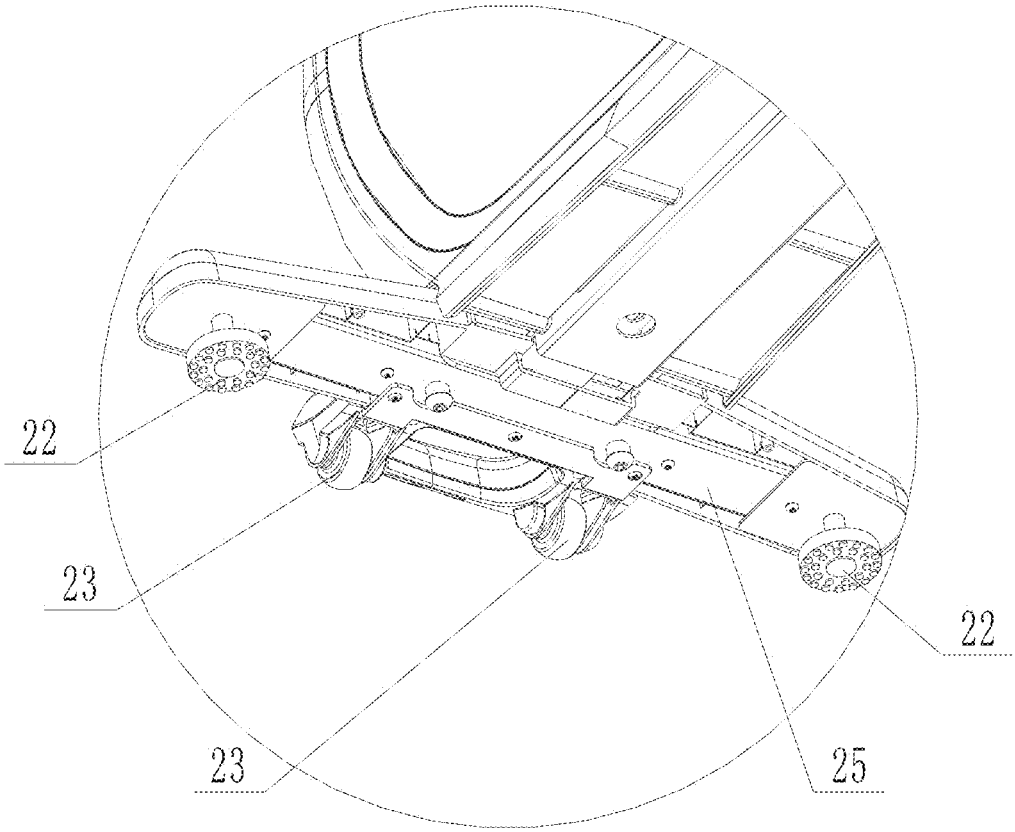
FIG. 5 is a partial enlarged view at B in FIG. 3.
Figure 6:
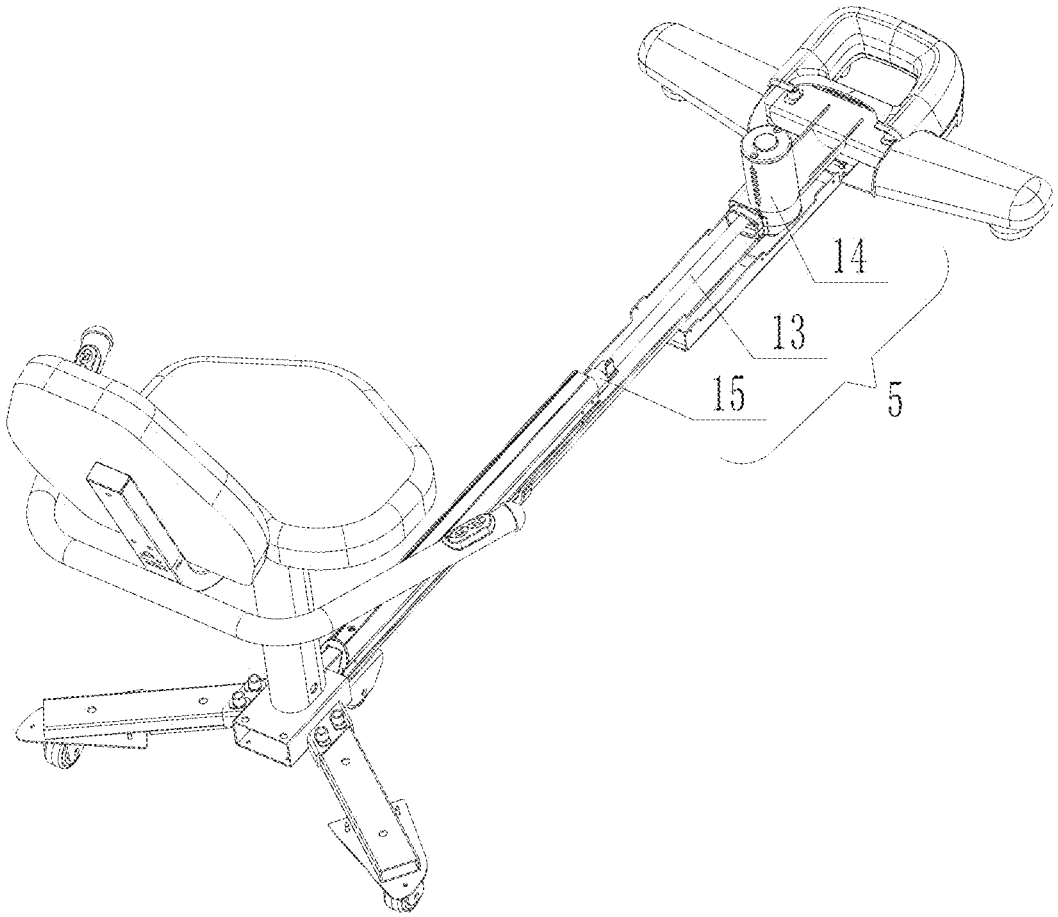
FIG. 6 is a partial cross-sectional structural diagram of the present invention.
Figure 7:
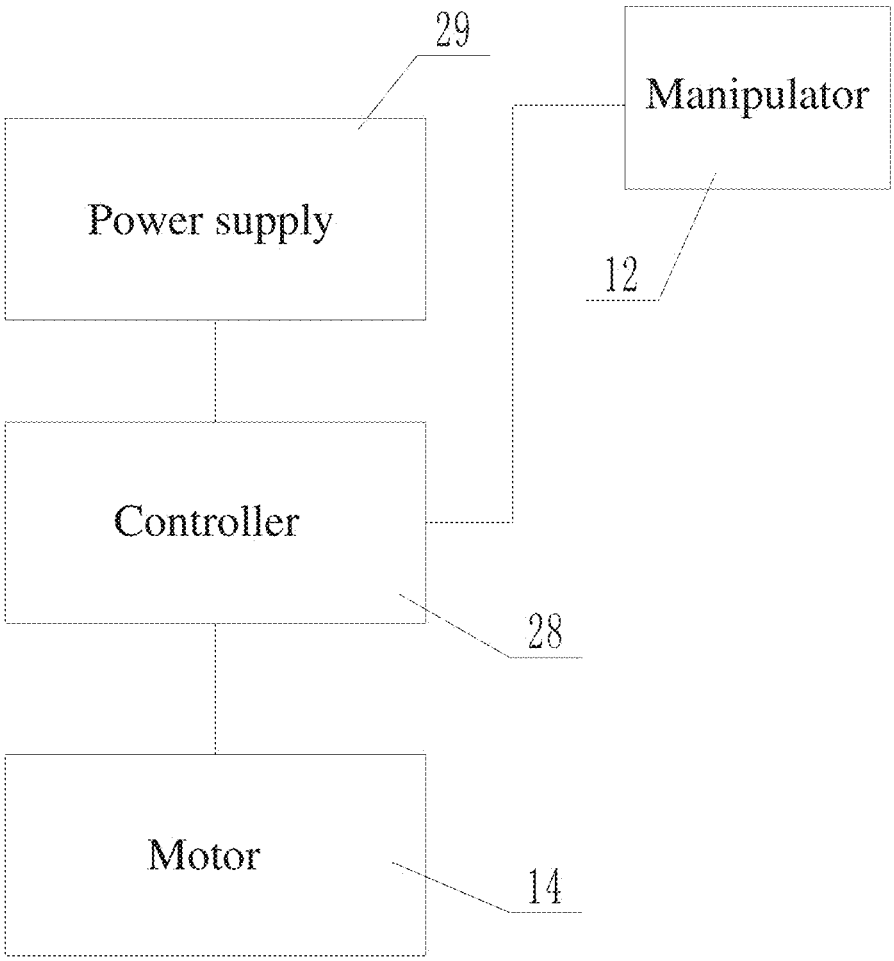
FIG. 7 is a block diagram of circuit connection of the present invention.

The present invention provides an electric telescopic horizontal bike, as shown in FIGS. 1-7, including a main frame 1, a damping pedal assembly 2, a sliding rod 3, a seat 4 and an electric driving mechanism 5.

The main frame 1 stands on the ground, one outer pipe 24 is disposed at a rear part of the main frame 1 in a back-and-forth extension manner, one transverse pipe 25 is disposed at a front part of the main frame 1 in a left-right extension manner, a front end of the outer pipe 24 is fixedly connected with a middle part of the transverse pipe 25, and supporting feet 22 are disposed at a left side and a right side of a bottom side of the transverse pipe 25 respectively, so that the main frame 1 stands on the ground through the supporting feet 22.

The damping pedal assembly 2 is disposed on the main frame 1, specifically above the transverse pipe 25 and the outer pipe 24 in this embodiment; the damping pedal assembly 2 can be a damping pedal structure on any existing fitness bike, which is not specifically limited. Specifically, in this embodiment, the damping pedal assembly 2 includes a rotating shaft, a damping mechanism, a left crank 18, a right crank 19, a left pedal 20 and a right pedal 21, the rotating shaft and the damping mechanism are not shown in the attached drawings, and are of conventional design in the art; the rotating shaft is mounted on the main frame, and extends laterally from left to right and can rotate around an axis; the damping mechanism is in transmission connection with the rotating shaft, and can be a damping wheel that generates damping through a magnetic force or friction, which is the prior art and will not be described in detail in this embodiment, and damping is further provided for the rotation of the rotating shaft around the axis through the damping mechanism; one end of the left crank 18 is connected to a left end of the rotating shaft, and the other end of a right crank 19 is connected to a right end of the rotating shaft, so that the left crank 18, the right crank 19 and the rotating shaft are connected to form a Z-shape; the left pedal 20 is transversely pivoted to the other end of the left crank 18, and the right pedal 21 is transversely pivoted to the other end of the right crank 19, so that when a user steps on the left pedal 20 with his left foot and on the right pedal 21 with his right foot, and pedals to simulate the action of riding a bicycle, the rotating shaft will be driven to rotate, and the damping mechanism provides a certain resistance for the rotation of the rotating shaft, thereby achieving a fitness effect.

The sliding rod 3 is disposed at the rear part of the main frame 1 in a back-and-forth sliding manner, and specifically in this embodiment, the sliding rod 3 is movably inserted into a rear end of the outer pipe 24, so that the sliding rod 3 is disposed at the rear part of the main frame 1 in a back-and-forth sliding manner; a seat fixing part 6 is provided at a rear part of the sliding rod 3, first rollers 7 are disposed at a bottom side of the seat fixing part 6, the first rollers 7 stand on the ground to be able to roll back and forth as the sliding rod 3 slides back and forth. Specifically, in this embodiment, a number of the first rollers 7 is three, and connecting lines of positions of the three first rollers 7 are distributed in a triangular shape, so as to prevent a situation that normal sliding of the sliding rod 3 is affected when the seat fixing part 6 swings and exerts a load on the sliding rod 3, allowing a back-and-forth sliding process of the sliding rod 3 to be smoother.

The seat 4 includes a seat surface 9, a backrest 10 and armrests 11, the seat surface 9 is used for a human body to sit on, the backrest 10 is disposed at a rear side of the seat surface 9 and forms a certain angle with the seat surface 9 for the human body to lean on, and the armrests 11 extend on sides of the seat surface 9; and specifically, in this embodiment, the armrests are disposed on a left side and a right side of the seat surface 9 for the human body to grasp. The seat 4 is mounted above the seat fixing part 6, and mounting structures and positions are not specifically limited. Specifically, in this embodiment, the seat fixing part 6 is provided with one supporting rod 8 extending upward within a range of the connecting lines of the positions of the three first rollers 7, and the seat 4 is mounted at a top end of the supporting rod 8, so that after a human sits in the seat 4, the whole center of gravity will stand within the connecting lines of the positions of the three first rollers 7 and be supported by the three first rollers 7, thereby preventing the sliding rod 3 from being subjected to a twisting or bending stress.

The electric driving mechanism 5 can be any existing linear driving mechanism, the electric driving mechanism 5 is disposed between the main frame 1 and the sliding rod 3, and is connected with the sliding rod and used for driving the sliding rod 3 to slide back and forth to drive the seat 4 to shift back and forth, and then the sliding rod 3 can be driven by the electric driving mechanism 5 to slide backward and drive the seat 4 to move backward, such that the seat 4 gets far away from the damping pedal assembly 2, to form enough space between the damping pedal assembly 2 and the seat 4, which is more convenient for the user to get on and off the seat 4. When the user sits on the seat 4, the sliding rod 3 can be driven to slide forward by the electric driving mechanism 5, and then the seat 4 can be driven to move forward, so that a distance between the seat 4 and the damping pedal assembly 2 can be reduced to an extent which is convenient for the user to exercise. Specifically, in one embodiment, the electric driving mechanism 5 includes a lead screw 13, a motor 14 and a lead screw nut 15, the lead screw 13 extends back and forth and is rotatably mounted on the main frame 1 around an axis, and is specifically disposed in the outer pipe 24, the motor 14 is mounted on the main frame 1 and is connected to and drives the lead screw 13 to rotate forward or reversely, the lead screw nut 15 is in screw-thread fit with the lead screw 13, and the sliding rod 3 is fixed with the lead screw nut 15 to slide forward or backward respectively under the driving of forward or reverse rotation of the lead screw 13.

Preferably, the electric telescopic horizontal bike also includes a manipulator 12, the manipulator 12 controls and is connected to the electric driving mechanism 5 through a controller 28, and, specifically in this embodiment, controls and is connected to a motor 14 of the electric driving mechanism 5. The controller 28 can be any existing controller such as a single chip microcomputer or PLC, and is electrically connected with a power supply 29, which can be any power supply device such as a mains supply or a storage battery. The manipulator 12 is disposed on the armrests 11, so as to control the motor 14 to rotate forward and reversely or stop, and then drive the sliding rod 3 to slide forward and backward or stop. Preferably, in this embodiment, the manipulator 12 includes a forward button 26 and a backward button 27. When the user presses the forward button 26, a signal is sent to the controller 28, so that the controller 28 controls the motor 14 to rotate forward and the seat 4 is moved forward; and when the user presses the backward button 27, another signal is sent to the controller 28, so that the controller 28 controls the motor 14 to rotate reversely and the seat 4 is moved backward.

The main frame 1 is provided with second rollers 23 at front sides of the supporting feet 22, and the second rollers 23 are capable of rolling back and forth, so that when the horizontal bike needs to be moved, the horizontal bike can be pushed to move simply by lifting the rear part of the horizontal bike to allow the second rollers 23 to stand to the ground and the supporting feet 22 to leave the ground, which is more convenient and labor-saving.

The above description is only a preferred embodiment of the present invention and is not intended to limit the design of the present invention, and all equivalent variations that are made by the design key of the present invention will stand within the protection scope of the present invention.

The invention claimed is:

1. An electric telescopic horizontal bike, comprising a main frame, a damping pedal assembly, a sliding rod, a seat and an electric driving mechanism, wherein supporting feet are disposed at a bottom side of the main frame, and the main frame stands on ground through the supporting feet;

the damping pedal assembly is disposed on the main frame;

the sliding rod is disposed at a rear part of the main frame in a back-and-forth sliding manner, a seat fixing part is provided at a rear part of the sliding rod, first rollers are disposed at a bottom side of the seat fixing part, and the first rollers stand on the ground and are capable of rolling back and forth;

the seat is mounted above the seat fixing part;

the electric driving mechanism is disposed between the main frame and the sliding rod, and is connected with the sliding rod and configured for driving the sliding rod to slide back and forth, so as to drive the seat to move back and forth; and the main frame is provided with second rollers at front sides of the supporting feet, and the second rollers are capable of rolling back and forth.

2. The electric telescopic horizontal bike according to claim 1, wherein a number of the first rollers is three, and connecting lines of positions of the three first rollers are distributed in a triangular mode.

3. The electric telescopic horizontal bike according to claim 2, wherein the seat fixing part is provided with one supporting rod extending upward within a range of the connecting lines of the positions of the three first rollers, and the seat is mounted at a top end of the supporting rod.

4. The electric telescopic horizontal bike according to claim 1, wherein the seat comprises a seat surface, a backrest and armrests, the seat surface is configured for a user to sit on, the backrest is disposed at a rear side of the seat surface and is configured for the user to lean on, and the armrests extend on sides of the seat surface.

5. The electric telescopic horizontal bike according to claim 4, wherein the electric telescopic horizontal bike further comprises a manipulator, the manipulator controls and is connected with the electric driving mechanism and is disposed on the armrests, so as to control the electric driving mechanism to drive the sliding rod to slide back and forth or stop.

6. The electric telescopic horizontal bike according to claim 5, wherein the manipulator comprises a forward button and a backward button.

7. The electric telescopic horizontal bike according to claim 1, wherein one outer pipe is disposed at the rear part of the main frame in a back-and-forth extension manner, and the sliding rod is movably inserted into a rear end of the outer pipe so as to be disposed at the rear part of the main frame in the back-and-forth sliding manner.

8. The electric telescopic horizontal bike according to claim 7, wherein one transverse pipe is disposed at a front part of the main frame in a left-right extension manner, and a front end of the outer pipe is fixedly connected with a middle part of the transverse pipe.

9. The electric telescopic horizontal bike according to claim 8, wherein the damping pedal assembly is disposed above the transverse pipe and the outer pipe.

10. The electric telescopic horizontal bike according to claim 1, wherein the electric driving mechanism comprises a lead screw, a motor and a lead screw nut, the lead screw extends back and forth and is rotatably mounted on the main frame around an axis, the motor is mounted on the main frame and connected to drive the lead screw to rotate forward or reversely, the lead screw nut is in screw-thread fit with the lead screw, and the sliding rod is fixed with the lead screw nut to slide forward or backward respectively under driving of forward or reverse rotation of the lead screw.

11. An electric telescopic horizontal bike, comprising a main frame, a damping pedal assembly, a sliding rod, a seat and an electric driving mechanism, wherein the main frame stands on ground;

the damping pedal assembly is disposed on the main frame;

the sliding rod is disposed at a rear part of the main frame in a back-and-forth sliding manner, a seat fixing part is provided at a rear part of the sliding rod, first rollers are disposed at a bottom side of the seat fixing part, and the first rollers stand on the ground and are capable of rolling back and forth;

the seat is mounted above the seat fixing part;

the electric driving mechanism is disposed between the main frame and the sliding rod, and is connected with the sliding rod and configured for driving the sliding rod to slide back and forth, so as to drive the seat to move back and forth; and one outer pipe is disposed at the rear part of the main frame in a back-and-forth extension manner, and the sliding rod is movably inserted into a rear end of the outer pipe so as to be disposed at the rear part of the main frame in the back-and-forth sliding manner.

12. The electric telescopic horizontal bike according to claim 11, wherein one transverse pipe is disposed at a front part of the main frame in a left-right extension manner, and a front end of the outer pipe is fixedly connected with a middle part of the transverse pipe.

13. The electric telescopic horizontal bike according to claim 12, wherein the damping pedal assembly is disposed above the transverse pipe and the outer pipe.

14. An electric telescopic horizontal bike, comprising a main frame, a damping pedal assembly, a sliding rod, a seat and an electric driving mechanism, wherein the main frame stands on ground;

the damping pedal assembly is disposed on the main frame;

the sliding rod is disposed at a rear part of the main frame in a back-and-forth sliding manner, a seat fixing part is provided at a rear part of the sliding rod, first rollers are disposed at a bottom side of the seat fixing part, and the first rollers stand on the ground and are capable of rolling back and forth;

the seat is mounted above the seat fixing part;

the electric driving mechanism is disposed between the main frame and the sliding rod, and is connected with the sliding rod and configured for driving the sliding rod to slide back and forth, so as to drive the seat to move back and forth; and a number of the first rollers is three, and connecting lines of positions of the three first rollers are distributed in a triangular mode.

15. The electric telescopic horizontal bike according to claim 14, wherein the seat fixing part is provided with one supporting rod extending upward within a range of the connecting lines of the positions of the three first rollers, and the seat is mounted at a top end of the supporting rod.

* * * * *